US010890393B1

(12) United States Patent
Schoettle

(10) Patent No.: US 10,890,393 B1
(45) Date of Patent: Jan. 12, 2021

(54) FIREARM CARTRIDGE EXTRACTION TOOL

(71) Applicant: David Schoettle, Gilbertsville, PA (US)

(72) Inventor: David Schoettle, Gilbertsville, PA (US)

( * ) Notice: Subject to any disclaimer, the term of this patent is extended or adjusted under 35 U.S.C. 154(b) by 268 days.

(21) Appl. No.: 16/106,332

(22) Filed: Aug. 21, 2018

(51) Int. Cl.
*F41A 15/22* (2006.01)

(52) U.S. Cl.
CPC ..... *F41A 15/22* (2013.01)

(58) Field of Classification Search
CPC . F41A 15/22; F41A 15/00; B25B 5/00; B25B 5/006
USPC ..... 81/3.05; 269/143, 249
See application file for complete search history.

(56) References Cited

U.S. PATENT DOCUMENTS 543,652 A 7/1895 Palm
985,190 A 2/1911 Mauser
3,564,950 A 2/1971 Jorczak
3,731,587 A 5/1973 Digiacomo
3,750,262 A 8/1973 Taylor
4,028,989 A * 6/1977 Vassallo ..... F42B 33/06 86/49
4,438,913 A * 3/1984 Hylla ..... F41A 23/18 248/534
4,442,619 A 4/1984 McCarley
5,111,608 A 5/1992 Weisheit
8,888,084 B1 * 11/2014 Aldredge ..... B25B 1/22 269/95
8,905,391 B2 * 12/2014 Weissenborn ..... B25B 27/0071 269/101

FOREIGN PATENT DOCUMENTS

WO 2016020183 2/2016

* cited by examiner

*Primary Examiner* — Hadi Shakeri

(57) ABSTRACT

The firearm cartridge extraction tool is used to open a jammed slide to extract a cartridge. The firearm cartridge extraction tool comprises a support frame, an arm, and a push rod. The support frame holds the arm above a work surface and provides a padded stop for the grip of the firearm. The arm may slide along a guide track to adjust for the size of the firearm. The arm holds the push rod in a position where it may align with the muzzle of the firearm. The pushrod comprises a main screw with a handle on one end and a swivel mounted male coupler on the other end. As the handle is turned, the main screw may push a socket located on the male coupler over the muzzle while the padded stop prevents movement of the firearm, thus forcing the slide to open.

17 Claims, 6 Drawing Sheets

FIREARM CARTRIDGE EXTRACTION TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of firearms and firearm tools, more specifically, a firearm cartridge extraction tool.

Summary of Invention

The firearm cartridge extraction tool is used to open a jammed slide to extract a cartridge. The firearm cartridge extraction tool comprises a support frame, an arm, and a push rod. The support frame holds the arm above a work surface and provides a padded stop for the grip of the firearm. The arm may slide along a guide track to adjust for the size of the firearm. The arm holds the push rod in a position where it may align with the muzzle of the firearm. The pushrod comprises a main screw with a handle on one end and a swivel mounted male coupler on the other end. As the handle is turned, the main screw may push a socket located on the male coupler over the muzzle while the padded stop prevents movement of the firearm, thus forcing the slide to open.

An object of the invention is to provide a cartridge extraction tool for a firearm.

Another object of the invention is to provide a support frame with an adjustable arm to accommodate firearms of various sizes.

A further object of the invention is to provide a pushrod that couples to a standard ⅜ inch socket.

Yet another object of the invention is to provide a tool that presses the socket over the muzzle of the firearm while preventing movement of the firearm to force the slide open.

These together with additional objects, features and advantages of the firearm cartridge extraction tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the firearm cartridge extraction tool in detail, it is to be understood that the firearm cartridge extraction tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the firearm cartridge extraction tool.

It is therefore important that the claims be regarded as including such equivalent construction insofar as they do not depart from the spirit and scope of the firearm cartridge extraction tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
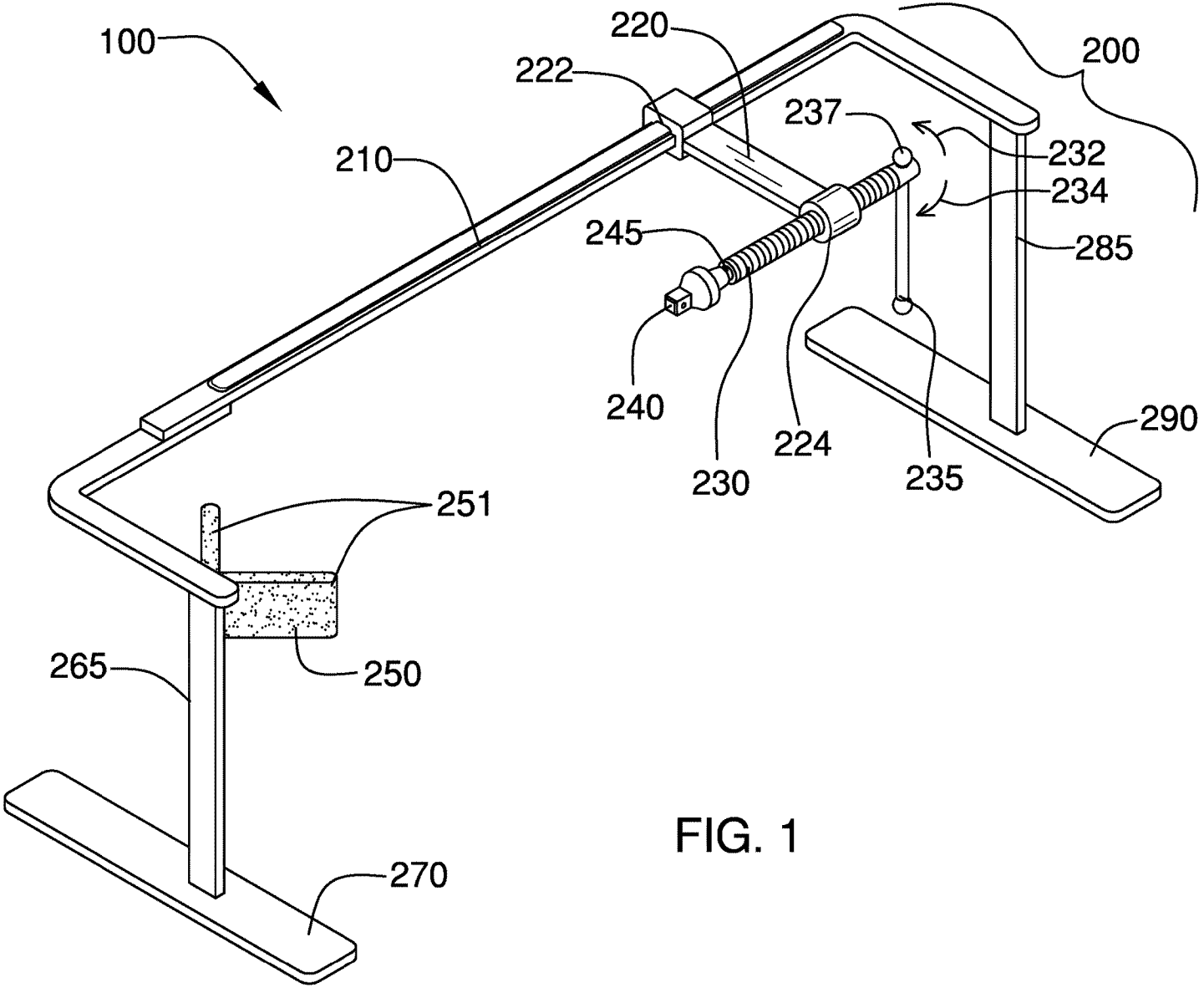
FIG. 1 is a perspective view of an embodiment of the disclosure.
Figure 2:
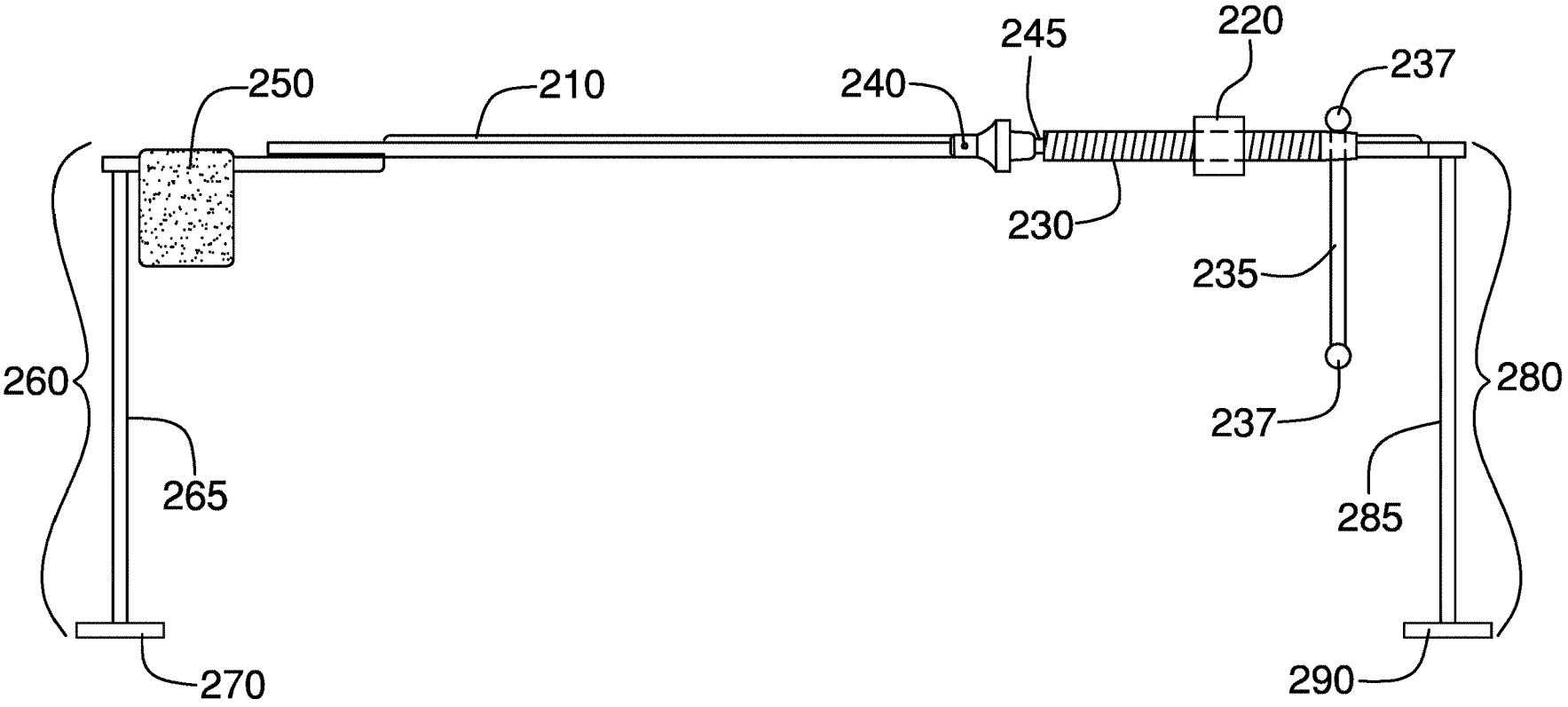
FIG. 2 is a front view of an embodiment of the disclosure.
Figure 3:
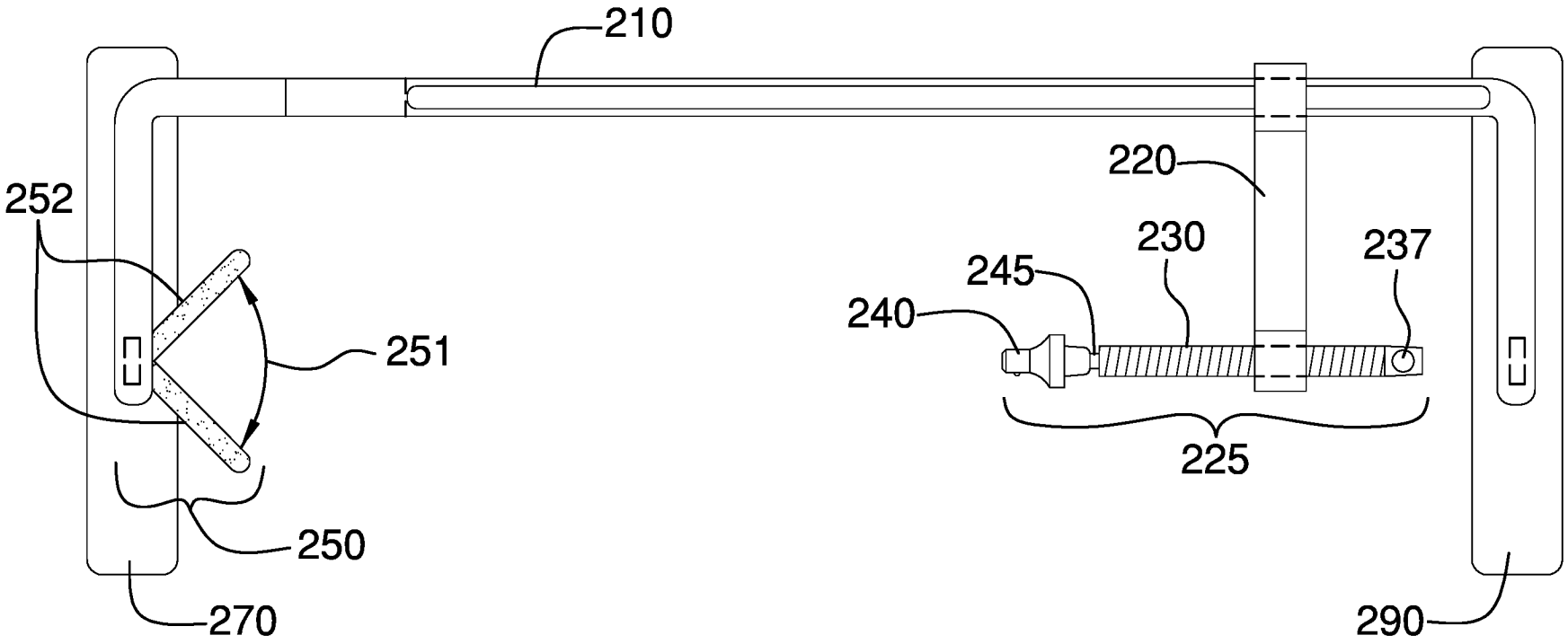
FIG. 3 is a top view of an embodiment of the disclosure.
Figure 4:
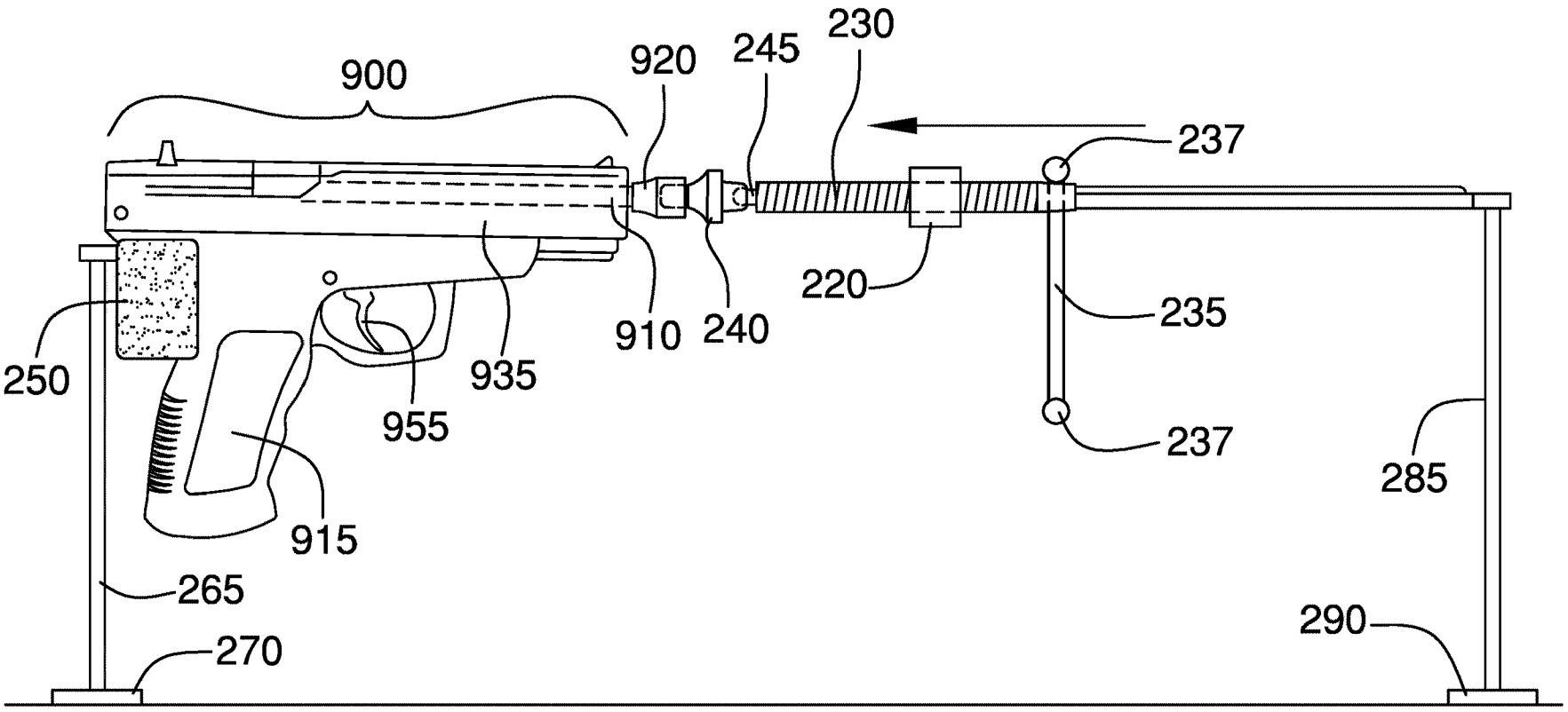
FIG. 4 is a in-use view of an embodiment of the disclosure.
Figure 5:
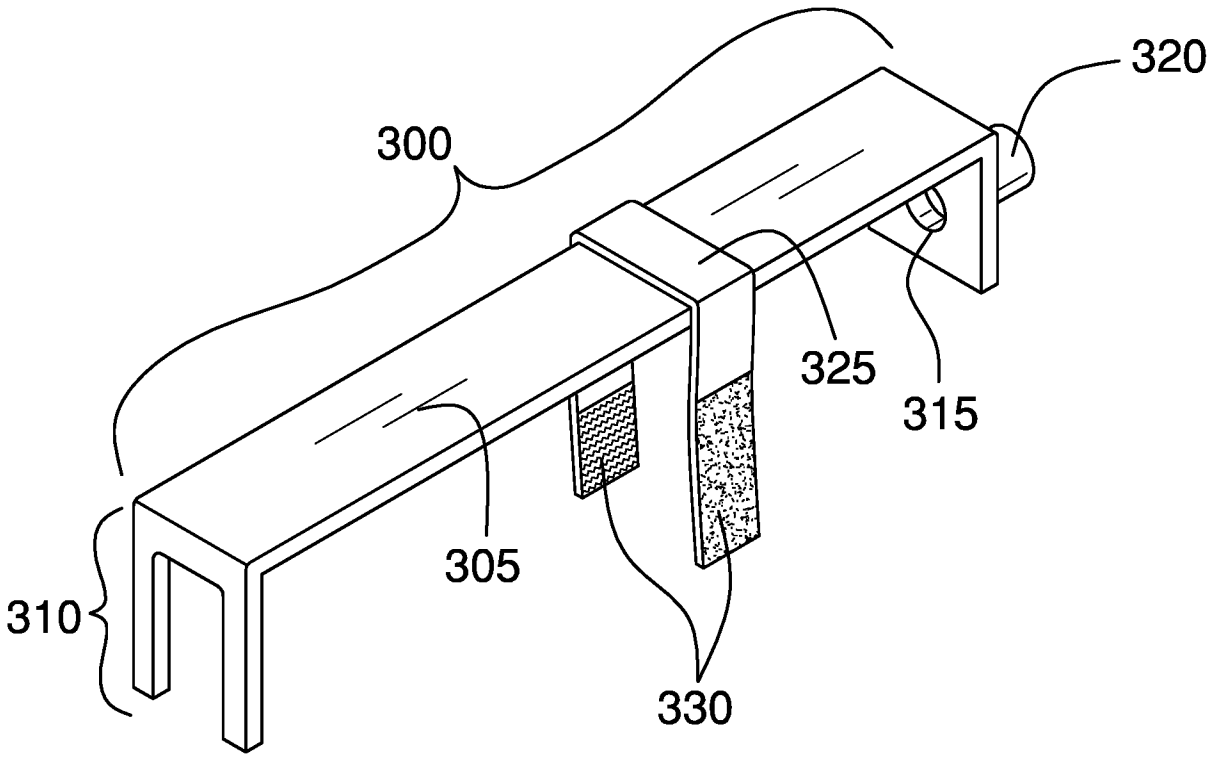
FIG. 5 is a perspective view of an embodiment of the disclosure showing the accessory adapter.
Figure 6:
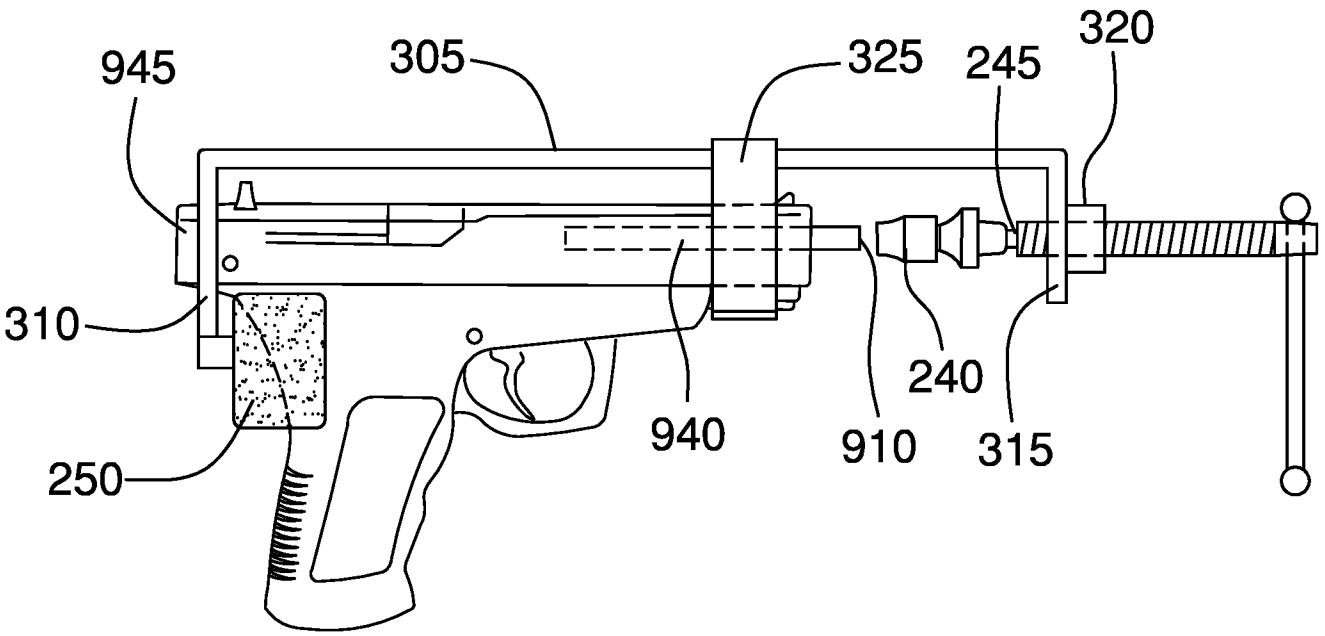
FIG. 6 is a detail view of an embodiment of the disclosure showing use of the accessory adapter.

Detailed reference will now be made to a first potential embodiment of the disclosure, which is illustrated in FIGS. 1 through 6.

The firearm cartridge extraction tool 100 (hereinafter invention) comprises a support frame 200, an arm 220, and a push rod 225. The invention 100 is configured for use with a firearm 900 that holds a cartridge (not illustrated in the figures) that has failed to eject. The invention 100 may push a slide 935 back so that the cartridge may be removed from a chamber of the firearm 900.

Throughout this disclosure, directional references are given from the point of view of a user (not illustrated in the figures) standing in front of the invention 100 such that a guide track 210 defines the rear of the invention 100 and the arm 220 protrudes from the guide track 210 towards the front of the invention 100. A handle 235 is located on the right side of a main screw 230 and defines the right side of the invention 100. A swivel joint 245 and a male coupler 240 are located on the left side of the main screw 230 and define the left side of the invention 100.

The support frame 200 comprises the guide track 210, a left base stand 260, a right base stand 280, and a padded stop 250. The guide track 210 may be a horizontal arm located at the rear of the support frame 200. The guide track 210 may pass through a track aperture 222 on the rear of the arm 220. The guide track 210 may be a guide rail for the arm 220 such that the arm 220 may slide to the left and to the right along the guide track 210 while remaining horizontally oriented.

The left side of the guide track 210 may bend forward and extend horizontally towards the front of the invention 100. In some embodiments, the right side of the guide track 210 may also bend forward and extend horizontally towards the front of the invention 100.

The left base stand 260 may elevate the left side of the invention 100. The left base stand 260 may comprise a left leg 265 and a left foot 270. The left leg 265 may be a vertical arm that couples the guide track 210 to the left foot 270. The top of the left leg 265 may be coupled to left side of the guide track 210. The bottom of the left leg 265 may be coupled to a midpoint of the top surface of the left foot 270. The left foot 270 may be a horizontal arm that runs from front to rear. The bottom surface of the left foot 270 may rest upon a workbench or other work surface (not illustrated in the figures) when the invention 100 is in use.

The right base stand 280 may elevate the right side of the invention 100. The right base stand 280 may comprise a right leg 285 and a right foot 290. The right leg 285 may be a vertical arm that couples the guide track 210 to the right foot 290. The top of the right leg 285 may be coupled to right side of the guide track 210. The bottom of the right leg 285 may be coupled to a midpoint of the top surface of the right foot 290. The right foot 290 may be a horizontal arm that runs from front to rear. The bottom surface of the right foot 290 may rest upon the workbench or other work surface when the invention 100 is in use.

The padded stop 250 may be a cushioned brace that a grip 915 of the firearm 900 may press against while the invention 100 is in use. The padded stop 250 may be coupled to the left side of the support frame 200 at the front of the guide track 210. The padded stop 250 may have an angle 251 formed between two stop arms 252. The angle 251 may be a right angle, which is 90 degrees.

The arm 220 may be a horizontal arm. The rear end of the arm 220 may be slidably coupled to the guide track 210 via the track aperture 222. The track aperture 222 may be oriented to pass through the arm 220 from left to right. The track aperture 222 may be non-circular so as to prevent the arm 220 from rotating from its horizontal orientation. As a nonlimiting example, the track aperture 222 may be a rectangular shape. The dimensions of the track aperture 222 may be such that the arm 220 may slide over the guide track 210 if the arm 220 is oriented to be perpendicular to the guide track 210 and the arm 220 may bind and prevent sliding on the guide track 210 if the arm 220 is canted away from being perpendicular to the guide track 210.

The front end of the arm 220 may comprise a screw aperture 224. The screw aperture 224 may be a threaded hole that passes through the arm 220 from left to right. The main screw 230 may be movably coupled to the arm 220 via the screw aperture 224.

The push rod 225 comprises the main screw 230, the handle 235, the swivel joint 245, and the male coupler 240. The main screw 230 may be a threaded shaft that passes through the screw aperture 224 of the arm 220. The diameter of the main screw 230 and the dimensions of threads on the main screw 230 may complement the diameter and thread dimensions of the screw aperture 224 such that when the main screw 230 is rotated in a first rotational direction 232 the main screw 230 is drawn through the screw aperture 224 in a left to right direction and when the main screw 230 is rotated in a second rotational direction 234 the main screw 230 is drawn through the screw aperture 224 in a right to left direction.

The handle 235 may be a rod that passes through the right end of the main screw 230 and is held captive to the main screw 230 by handle stops 237 coupled to each end of the handle 235. The handle 235 may be used to rotate the main screw 230 in order to move the push rod 225 to the right or to the left.

The swivel joint 245 may be an articulation between the left end of the main screw 230 and the male coupler 240. The swivel joint 245 may allow the male coupler 240 to rotate independently of the main screw 230. The swivel joint 245 may allow the male coupler 240 pivot vertically, horizontally, or a combination thereof. The swivel joint 245 may enable the male coupler 240 to be out of alignment and stationary relative to the main screw 230.

The left side of the male coupler 240 may be a male square drive post for a socket set (not illustrated in the figures). The male coupler 240 may be configured to couple a socket 920 from the socket set to the left end of the push rod 225. The male coupler 240 may comprise ball retention to hold the socket 920 onto the male coupler 240. In some embodiments, the left side of the male coupler 240 may be a ⅜ inch square drive post. As the socket 920 is pushed against the front of the firearm 900 it may push against the slide 935. Since the firearm 900 is prevented from moving by the padded stop 250 against the grip 915, the slide 935 may be pushed open so that the cartridge causing the jam may be removed. As the slide 935 opens, a muzzle 910 of the firearm 900 may move into the central opening of the socket 920 and the muzzle 910 will not be damaged.

The invention 100 may further comprise an accessory adapter 300. If the firearm 900 has a rear actuator, the slide 935 may not be accessible at the front of the firearm 900 and therefore the socket 920 may not be able to open the slide 935 from the front of the firearm 900. In those cases, the accessory adapter 300 may be used in place of the socket 920. The accessory adapter 300 may comprise an adapter main arm 305, a vertical fork 310, an upright 315, a female square drive coupler 320, and a barrel strap 325. The adapter main arm 305 may be a bar running from left to right. The adapter main arm 305 may be at least as long as the longest dimension of the firearm 900 as measured from the front of the muzzle 910 to the rear of the firearm 900 with the chamber open.

The vertical fork 310 may be two vertical extensions downward from the left end of the adapter main arm 305. The horizontal separation of the two vertical extensions is at least the width of the body of the firearm 900 so that the firearm 900 fits between them. The vertical length of the vertical fork 310 may be at least the distance from the highest point on the firearm 900 to the bottom of a trigger 955 on the firearm 900. The vertical fork 310 is configured to fit in front of a charging handle 945 on each side of the firearm 900 when in use. When the push rod 225 moves the accessory adapter 300 to the left, the vertical fork 310 pushes the slide 935 of the firearm 900 with a rear actuator open.

The upright 315 may be a vertical extension downward from the right side of the adapter main arm 305. The vertical length of the upright 315 may be substantially the same as the vertical length of the vertical fork 310. The female square drive coupler may be coupled to the right side of the upright 315 at a midpoint of the upright 315. The female square drive coupler 320 provides a female square drive aperture to mate with the male coupler 240 on the push rod 225. The female square drive coupler 320 effectively looks like a socket coupled to the accessory adapter 300 so that the accessory adapter 300 may be used in place of the socket 920 to open the slide 935 of the firearm 900.

The barrel strap 325 may be a flexible band that may be wrapped around the accessory adapter 300 and a barrel 940 of the firearm 900 to support the firearm 900 in a position beneath the accessory adapter 300. The ends of the barrel strap 325 may removably couple to each other using strap fasteners 330 to hold the firearm 900 in place. As a non-limiting example, the ends of the barrel strap 325 may couple to each other using hook and loop fasteners.

To use the invention 100, the socket 920 is selected from the socket set for use on the firearm 900. The socket 920 that is selected must have a central opening that is large enough for the muzzle 910 of the firearm 900 to fit inside of. The socket 920 that is selected is placed onto the male coupler 240 by engaging the square drive hole on the bottom of the socket 920 with the male, square drive post on the left side of the male coupler 240. The firearm 900 is prepared by removing a magazine (not illustrated in the figures). The handle 235 is used to move the main screw 230 to the right so that at least ½ of the thread on the main screw 230 is showing to the left of the arm 220. The arm 220 is slid left of right until the socket 920 is in front of the firearm 900 when the firearm 900 is against the padded stop 250. The firearm 900 is then positioned with the back of the grip 915 against the padded stop 250 and the handle 235 is used to rotate the main screw 230 so that the main screw 230 moves to the left.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "accessory" is a second object that adds to the convenience or attractiveness of a first object. In some instances, an accessory may extend the functionality of the first object by allowing the combination of the accessory plus the first object to perform a task that the first object could not perform alone.

As used in this disclosure, an "aperture" is an opening in a surface. Aperture may be synonymous with hole, slit, crack, gap, slot, or opening.

As used in this disclosure, a "band" is a flat loop of material.

As used in this disclosure, a "cant" is an angular deviation from one or more reference planes such as a vertical plane or a horizontal plane.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "firearm" is a handheld weapon designed to expel a projectile, which has been accelerated using a mechanism comprising an explosion.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "grip" is a covering that is placed over a hand hold, handle, shaft, or other object.

As used in this disclosure, a "handle" is an object by which a tool, object, or door is held or manipulated with the hand.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, "horizontal" is a directional term that refers to a direction that is perpendicular to the local force of gravity. Unless specifically noted in this disclosure, the horizontal direction is always perpendicular to the vertical direction.

As used herein, "mate" refers to coupling at a predefined interface.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 50% of the distance from the exact midpoint to the farthest edge.

As used in this disclosure, "orientation" refers to the positioning and/or angular alignment of a first object relative to a second object or relative to a reference position or reference direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, a "rod" is a straight structure in which two dimensions of the structure appear thin relative to a third dimension of the straight structure.

As used in this disclosure, the term "shaft" is used to describe a rigid cylinder that is often used as the handle of a tool or implement. The definition of shaft explicitly includes solid shafts or shafts that comprise a hollow passage through the shaft along the center axis of the shaft cylinder, whether the shaft has one or more sealed ends or not.

As used in this disclosure a "strap" is a strip of leather, cloth, plastic, thin metal, or other flexible material, often with a buckle, that is used to fasten, secure, carry, or hold onto something.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are tolerable.

As used herein, a "swivel" is a coupling between two parts that allows one to revolve without turning the other.

As used in this disclosure, a "tool" is a device, an apparatus, or an instrument that is used to carry out an activity, operation, or procedure.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A firearm cartridge extraction tool comprising:

a support frame, an arm, and a push rod;

wherein the firearm cartridge extraction tool is configured for use with a firearm that holds a cartridge that has failed to eject;

wherein the firearm cartridge extraction tool pushes a slide back so that the cartridge is removed from a chamber of the firearm;

wherein the support frame comprises a guide track, a left base stand, a right base stand, and a padded stop;

wherein the guide track is a horizontal arm located at a rear of the support frame;

wherein the guide track passes through a track aperture on a rear of the arm;

wherein the guide track is a guide rail for the arm such that the arm slides to a left and to a right along the guide track while remaining horizontally oriented;

wherein a left side of the guide track bends forward and extends horizontally towards a front of the firearm cartridge extraction tool;

wherein the left base stand elevates a left side of the firearm cartridge extraction tool;

wherein the left base stand comprises a left leg and a left foot;

wherein the left leg is a vertical arm that couples the guide track to the left foot;

wherein a top of the left leg is coupled to the left side of the guide track;

wherein a bottom of the left leg is coupled to a midpoint of a top surface of the left foot;

wherein the left foot is a horizontal arm that runs from a front to a rear;

wherein a bottom surface of the left foot rests upon a workbench or other work surface when the firearm cartridge extraction tool is in use.

2. The firearm cartridge extraction tool according to claim 1 wherein a right side of the guide track bends forward and extends horizontally towards the front of the firearm cartridge extraction tool.

3. The firearm cartridge extraction tool according to claim 1 wherein the right base stand elevates a right side of the firearm cartridge extraction tool;

wherein the right base stand comprises a right leg and a right foot;

wherein the right leg is a vertical arm that couples the guide track to the right foot;

wherein a top of the right leg is coupled to the right side of the guide track;

wherein a bottom of the right leg is coupled to a midpoint of a top surface of the right foot;

wherein the right foot is a horizontal arm that runs from a front to a rear;

wherein a bottom surface of the right foot rests upon the workbench or other work surface when the firearm cartridge extraction tool is in use.

4. The firearm cartridge extraction tool according to claim 3 wherein the padded stop is a cushioned brace that a grip of the firearm presses against while the firearm cartridge extraction tool is in use;

wherein the padded stop is coupled to a left side of the support frame at the front of the guide track;

wherein the padded stop is further defined with an angle formed between two stop arms.

5. The firearm cartridge extraction tool according to claim 4 wherein the arm is a horizontal arm;

wherein a rear end of the arm is slidably coupled to the guide track via the track aperture;

wherein the track aperture is oriented to pass through the arm from a left to a right;

wherein the track aperture is non-circular so as to prevent the arm from rotating from its horizontal orientation.

6. The firearm cartridge extraction tool according to claim 5 wherein the track aperture is a rectangular shape.

7. The firearm cartridge extraction tool according to claim 5 wherein the dimensions of the track aperture are such that the arm slides over the guide track if the arm is oriented to be perpendicular to the guide track;

wherein the dimensions of the track aperture are such that the arm binds and prevents sliding on the guide track if the arm is canted away from being perpendicular to the guide track.

8. The firearm cartridge extraction tool according to claim 7 wherein a front end of the arm comprises a screw aperture;

wherein the screw aperture is a threaded hole that passes through the arm from a left to a right;

wherein a main screw is movably coupled to the arm via the screw aperture.

9. The firearm cartridge extraction tool according to claim 8 wherein the push rod comprises the main screw, a handle, a swivel joint, and a male coupler;

wherein the main screw is a threaded shaft that passes through the screw aperture of the arm;

wherein the diameter of the main screw and the dimensions of threads on the main screw complement the diameter and thread dimensions of the screw aperture such that when the main screw is rotated in a first rotational direction the main screw is drawn through the screw aperture in a left to right direction and when the main screw is rotated in a second rotational direction the main screw is drawn through the screw aperture in a right to left direction.

10. The firearm cartridge extraction tool according to claim 9 wherein the handle is a rod that passes through a right end of the main screw and is held captive to the main screw by handle stops coupled to each end of the handle;

wherein the handle is used to rotate the main screw in order to move the push rod to the right or to the left.

11. The firearm cartridge extraction tool according to claim 10 wherein the swivel joint is an articulation between a left end of the main screw and the male coupler;

wherein the swivel joint allows the male coupler to rotate independently of the main screw;

wherein the swivel joint allows the male coupler pivot vertically, horizontally, or a combination thereof;

wherein the swivel joint enables the male coupler to be out of alignment and stationary relative to the main screw.

12. The firearm cartridge extraction tool according to claim 11 wherein a left side of the male coupler is a male square drive post for a socket set;

wherein the male coupler is configured to couple a socket from the socket set to a left end of the push rod.

13. The firearm cartridge extraction tool according to claim 12 wherein the left side of the male coupler is a ⅜ inch square drive post.

14. The firearm cartridge extraction tool according to claim 12 wherein the firearm cartridge extraction tool comprises an accessory adapter;

wherein the accessory adapter comprises an adapter main arm, a vertical fork, an upright, a female square drive coupler, and a barrel strap;

wherein the adapter main arm is a bar running from left to right.

15. The firearm cartridge extraction tool according to claim 14 wherein the vertical fork comprises two vertical extensions downward from the left end of the adapter main arm;

wherein the horizontal separation of the two vertical extensions is at least the width of the body of the firearm so that the firearm fits between them;

wherein the vertical length of the vertical fork is at least the distance from the highest point on the firearm to the bottom of a trigger on the firearm;

wherein the vertical fork is configured to fit in front of a charging handle on each side of the firearm when in use;

wherein when the push rod moves the accessory adapter to the left, the vertical fork pushes the slide of the firearm with a rear actuator open.

16. The firearm cartridge extraction tool according to claim 15 wherein the upright is a vertical extension downward from the right side of the adapter main arm;

wherein the vertical length of the upright is substantially the same as the vertical length of the vertical fork;

wherein the female square drive coupler is coupled to the right side of the upright at a midpoint of the upright;

wherein the female square drive coupler provides a female square drive aperture to mate with the male coupler on the push rod.

17. The firearm cartridge extraction tool according to claim 16 wherein the barrel strap is a flexible band that is wrapped around the accessory adapter and a barrel of the firearm to support the firearm in a position beneath the accessory adapter;

wherein the ends of the barrel strap removably couple to each other using strap fasteners to hold the firearm in place.

* * * * *